US005472628A

United States Patent [19]

Panandiker et al.

[11] Patent Number: 5,472,628

[45] Date of Patent: Dec. 5, 1995

[54] LIQUID DETERGENTS WITH AN ARYL ACID FOR INHIBITION OF PROTEOLYTIC ENZYME

[75] Inventors: Rajan K. Panandiker, Cincinnati, Ohio; Christiaan A. J. K. Thoen, Haasdonk; Pierre M. A. Lenoir, Brussels, both of Belgium; Dwight M. Peterson, Wyoming; James E. Thompson, Cincinnati, both of Ohio

[73] Assignee: The Procter & Gamble Company, Cincinnati, Ohio

[21] Appl. No.: 336,884

[22] Filed: Nov. 9, 1994

Related U.S. Application Data

[63] Continuation of Ser. No. 988,400, Dec. 9, 1992, abandoned, which is a continuation of Ser. No. 693,516, Apr. 30, 1991, abandoned.

[51] Int. Cl.[6] ..... C11D 3/386; C11D 1/12; C11D 3/02

[52] U.S. Cl. ..... 252/135; 252/174.12; 252/DIG. 12; 252/544; 252/549; 252/DIG. 11; 252/550; 134/42

[58] Field of Search ..... 252/174.12, DIG. 12, 252/DIG. 14, 135, 549, 550, 544; 134/42

[56] References Cited

U.S. PATENT DOCUMENTS

| | | | |
|---|---|---|---|
| 3,912,595 | 10/1975 | Phillip et al. | 195/66 R |
| 4,261,868 | 4/1981 | Hora et al. | 252/529 |
| 4,532,064 | 7/1985 | Boskamp . | |
| 4,537,707 | 8/1985 | Severson, Jr. | 252/545 |
| 4,566,985 | 1/1986 | Bruno et al. | 254/174.12 |
| 4,747,977 | 5/1988 | Whitehead et al. | 252/111 |
| 4,842,758 | 6/1989 | Crutzen | 252/8.7 |
| 4,842,769 | 6/1989 | Shulman et al. | 252/8.6 |
| 4,900,475 | 2/1990 | Ramachandran et al. | 252/532 |
| 5,039,446 | 8/1991 | Estell . | |

FOREIGN PATENT DOCUMENTS

| | | |
|---|---|---|
| 0080223 | 6/1983 | European Pat. Off. . |
| 0218272 | 4/1987 | European Pat. Off. . |
| 0238216 | 9/1987 | European Pat. Off. . |
| 0293881 | 12/1988 | European Pat. Off. . |
| 0344828 | 12/1989 | European Pat. Off. . |
| 0376705 | 4/1990 | European Pat. Off. . |
| 0385401 | 5/1990 | European Pat. Off. . |
| 0381262 | 8/1990 | European Pat. Off. . |
| 0381262 | 8/1990 | European Pat. Off. . |
| 0399681 | 11/1990 | European Pat. Off. . |
| 0450702A2 | 10/1991 | European Pat. Off. . |
| 0478050 | 4/1992 | European Pat. Off. . |
| 0478050A1 | 4/1992 | European Pat. Off. . |
| 0486073 | 5/1992 | European Pat. Off. . |
| 3918761 | 6/1990 | Germany . |
| 2079305 | 1/1982 | United Kingdom . |
| 89/04361 | 5/1989 | WIPO . |
| WO91/13904 | 9/1991 | WIPO . |
| WO92/03529 | 3/1992 | WIPO . |

OTHER PUBLICATIONS

M. Phillip and Maripuri "Inhibition of Subtilisin by Substituted aryl boronic acids", FEBS Letters (133) (1) 1981.

CA99. 135992q The inhibition of class C B–lactamase by boronic acid.

Imperiali, B. and Abeles, R. H., "Inhibition of Serine Proteases", Biochemistry, vol. 25, 1986, Easton, Pa. U.S., pp. 3760–3767.

Kettner, C. A. and Shenvi, A. B., "Inhibition of the Serine Proteases Leukocyte Elastase, Pancreatic Elastase, Cathepsin G, and Chymotrypsin by Peptide Boronic Acids", Journal of Biological Chemistry, vol. 259, No. 24, 25 Dec. 1984, pp. 15106–15112.

Dawber et al in the Journal of Chemical Society, vol. 1, pp. 41–56 (1988).

Philipp, M. and Bender, M. L., "Kinetics of Subtilisin and Thiolsubtilisin", Molecular & Cellular Biochemistry, vol. 51, pp. 5–32 (1983).

"Equilibria Between Borate Ion and Some Polyols in Aqueous Solution" by Conner, J. M. and Bulgrin, V C, J. Inorg. Nucl. Chem., 1967, vol. 29, pp. 1953–1961.

"Studies on Borate Esters I" by Van Duin, M., Peters, J A, Kieboom, A Pb, and Van Bekkum, H., from *Tetrahedron*, vol. 40, No. 15, pp. 2901–2911 (1984).

"Raman Study of Aqueous Monoborate–Polyol Complexes. Equilibria in the Monoborate–1,2–Ethanediol System" by Oertel, R P, *Inorganic Chemistry*, vol. 11, No. 3, pp. 554–549.

"Mechanism of the Complexation of Boron Acids with Catechol and Substituted Catechols" by Pizer, R. and Babcock, L., *Inorganic Chemistry*, vol. 16, No. 7, pp. 1677–1681 (1977).

*Primary Examiner*—Christine Skane
*Assistant Examiner*—Kery A. Fries
*Attorney, Agent, or Firm*—George W. Allen

[57] ABSTRACT

Included is a liquid detergent composition comprising detersive surfactant, proteolytic enzyme, a detergent-compatible second enzyme, and an aryl boronic acid of the structure:

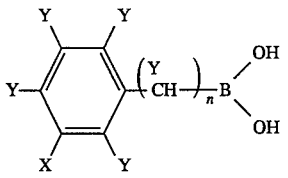

where X is selected from $C_1$–$C_6$ alkyl, substituted $C_1$–$C_6$ alkyl, aryl, substituted aryl, hydroxyl, hydroxyl derivative, amine, $C_1$–$C_6$ alkylated amine, amine derivative, halogen, nitro, thiol, thiol derivative, aldehyde, acid, acid salt, ester, sulfonate or phosphonate; each Y is independently selected from hydrogen, $C_1$–$C_6$ alkyl, substituted $C_1$–$C_6$ alkyl, aryl, substituted aryl, hydroxyl, hydroxyl derivative, halogen, amine, alkylated amine, amine derivative, nitro, thiol, thiol derivative, aldehyde, acid, ester, sulfonate or phosphonate; and n is 0 to 4.

20 Claims, No Drawings

LIQUID DETERGENTS WITH AN ARYL ACID FOR INHIBITION OF PROTEOLYTIC ENZYME

This is a continuation of abandoned application Ser. No. 07/988,400, filed on Dec. 9, 1992, which is in turn a continuation of abandoned application Ser. No. 07/693,516, filed on Apr. 30, 1991.

FIELD OF THE INVENTION

This invention relates to liquid detergent compositions containing an aryl boronic acid for inhibition of proteolytic enzyme. More specifically, this invention pertains to liquid detergent compositions containing a detersive surfactant, proteolytic enzyme, a detergent-compatible second enzyme, and an aryl boronic acid of the structure:

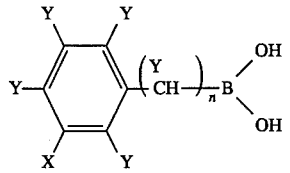

where X is selected from $C_1$–$C_6$ alkyl, substituted $C_1$–$C_6$ alkyl, aryl, substituted aryl, hydroxyl, hydroxyl derivative, amine, $C_1$–$C_6$ alkylated amine, amine derivative, halogen, nitro, thiol, thiol derivative, aldehyde, acid, acid salt, ester, sulfonate or phosphonate; each Y is independently selected from hydrogen, $C_1$–$C_6$ alkyl, substituted $C_1$–$C_6$ alkyl, aryl, substituted aryl, hydroxyl, hydroxyl derivative, halogen, amine, alkylated amine, amine derivative, nitro, thiol, thiol derivative, aldehyde, acid, ester, sulfonate or phosphonate; and n is 0 to 4.

BACKGROUND OF THE INVENTION

Protease-containing liquid detergent compositions are well known. A commonly encountered problem, particularly with heavy duty liquid laundry detergents, is the degradation by proteolytic enzyme of second enzymes in the composition, such as lipase, amylase and cellulase. The performance of the second enzyme upon storage and its stability in product are thus impaired by proteolytic enzyme.

Boronic acids are known to reversibly inhibit proteolytic enzyme. This inhibition of proteolytic enzyme by boronic acid is reversible upon dilution, as occurs in wash water. The inhibition constant ($K_i$) is ordinarily used as a measure of capacity to inhibit enzyme activity, with a low $K_i$ indicating a more potent inhibitor. However, it has been found herein that not all boronic acids are effective inhibitors of proteolytic enzyme in liquid detergents, particularly heavy duty liquid laundry detergents, regardless of their $K_i$ values. In fact, the class of boronic acids described herein are superior in liquid detergents, contrary to what one would expect.

A discussion of the inhibition of one proteolytic enzyme, subtilisin, is provided in Philipp, M. and Bender, M. L., "Kinetics of Subtilisin and Thiolsubtilisin", Molecular & Cellular Biochemistry, vol. 51, pp. 5–32 (1983). Inhibition constants for boronic acids are provided therein, and boronic acids are cited as subtilisin inhibitors. Low $K_i$ values are said to indicate more effective inhibitors.

One class of boronic acid, peptide boronic acid, is discussed as an inhibitor of trypsin-like serine proteases such as thrombin, plasma kallikrein and plasmin, especially in pharmaceuticals, in European Patent Application 0 293 881, Kettner et al., published Dec. 7, 1988.

European Patent Application Serial No. 90/870212, published November 14, 1990 discloses liquid detergent compositions containing certain bacterial serine proteases and lipases.

U.S. Pat. No. 4,908,150, Hessel et al, issued March 13, 1990 describes liquid detergent compositions containing lipolytic enzymes wherein the stability of the lipolytic enzyme is said to be improved by inclusion of particular nonionic ethylene glycol containing copolymers.

U.S. Pat. No. 4,566,985, Bruno et al, issued January 28, 1986 describes liquid cleaning compositions containing a mixture of enzymes including a protease and second enzymes. The composition also contains an effective amount of benzamidine hydrohalide to inhibit the digestive effect of protease on the second enzymes.

In European Application 0 376 705, Cardinali et al, published Jul. 4, 1990, liquid detergent compositions containing a mixture of lipolytic enzymes and proteolytic enzymes have been described. The storage stability of the lipolytic enzyme is said to be enhanced by the inclusion of a lower aliphatic alcohol and a salt of a lower carboxylic acid and a surfactant system which is predominantly nonionic.

In European Patent Application 0 381 262 Aronson et al, published Aug. 8, 1990, mixtures of proteolytic and lipolytic enzymes in a liquid medium have been disclosed. The stability of lipolytic enzyme is said to be improved by the addition of a stabilizing system comprising boron compound and a polyol which are capable of reacting, whereby the polyol has a first binding constant with the boron compound of at least 500 l/mole and a second binding constant of at least 1000 $l^2$/mole$^2$.

None of these teach or describe the use of aryl boronic acid which has a substitution at the 3-position relative to boron as an unexpectedly superior reversible inhibitor of proteolytic enzyme in liquid detergent compositions to protect second enzymes in the compositions.

SUMMARY OF THE INVENTION

The present invention relates to a liquid detergent composition comprising:

a. from about 0,001 to 10 weight % of aryl boronic acid of the following structure:

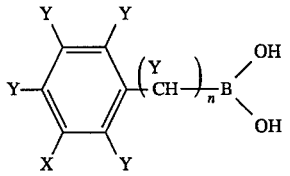

where X is selected from $C_1$–$C_6$ alkyl, substituted $C_1$–$C_6$ alkyl, aryl, hydroxyl, hydroxyl derivative, amine, $C_1$–$C_6$ alkylated amine, amine derivative, halogen, nitro, thiol, thiol derivative, aldehyde, acid, acid salt, ester, sulfonate or phosphonate; each Y is independently selected from hydrogen, $C_1$–$C_6$ alkyl, substituted $C_1$–$C_6$ alkyl, aryl, substituted aryl, hydroxyl, hydroxyl derivative, halogen, amine, alkylated amine, amine derivative, nitro, thiol, thiol derivative aldehyde, acid, ester, sulfonate or phosphonate, and n is 0 to 4.

b. from about 0.0001 to 1.0 weight % of active proteolytic enzyme;

c. a performance-enhancing amount of a detergent-compatible second enzyme; and d. from about 1 to 80 weight % of detersive surfactant.

DESCRIPTION OF THE INVENTION

The instant liquid detergent compositions contain four essential ingredients: (a) certain aryl boronic acids, (b) proteolytic enzyme, (c) detergent-compatible second enzyme, and (d) detersive surfactant.

A. Boronic Acid

It is generally believed that boronic acids inhibit proteolytic enzyme by attaching themselves at the active site on the proteolytic enzyme. A boron to serine covalent bond and a hydrogen bond between histidine and a hydroxyl group on the boronic acid are apparently formed. It is believed that the strength of these bonds determines the efficiency of the inhibitor and that the bond strength is determined by steric fitting of the inhibitor molecule in the enzyme's active site. Upon dilution, as under typical wash conditions, these bonds are broken and protease activity is regained.

It is believed that in liquid detergent compositions, the boronic acid-proteolytic enzyme bond strength is adversely affected by detersive surfactants. While not meaning to be bound by theory, it is believed to be important to have an optimum steric disposition in the boronic acid molecule to promote additional bonding and allow good proteolytic enzyme inhibition. It is theorized herein that this is achieved by placing a critical substituent group ("X" herein) on the aromatic ring of aryl boronic acid at the 3-position relative to boron. Suitable substituents (X) are: $C_1$ to $C_6$ alkyl, substituted $C_1$–$C_6$ alkyl, aryl, substituted aryl, hydroxyl, hydroxyl derivative, amine, $C_1$–$C_6$ alkylated amine, amine derivative, nitro, halogen, thiol, thiol derivative, aldehyde, acid, acid salt, ester, sulfonate, and phosphonate.

It is believed, that binding can be especially enhanced by placing in particular a hydrogen bonding group in the 3-position of the aromatic ring of aryl boronic acid. This seems to promote hydrogen bonding between the inhibitor and the proteolytic enzyme. These hydrogen bonding groups include amine, alkylated amine, amine derivative, nitro, hydroxyl, and hydroxyl derivative, which are preferred.

It is believed herein that a bond, probably a hydrogen bond or other interaction, between the X on aryl boronic acid and an amino acid (probably asparagine) on the proteolytic enzyme contributes to the particularly strong binding of this boronic acid to the proteolytic enzyme. The bonding is believed to be enhanced by the critical substitution in the 3-position on the aromatic ring relative to boron (X). It is believed that a strong covalent serine-hydroxyl bond, a weaker histidine-hydroxyl bond, possible hydrophobic interaction between the benzene ring and the proteolytic enzyme, and the asparagine-X bond (or interaction) are responsible for strong aryl boronic acid/proteolytic enzyme bonding and thus good inhibition of the proteolytic enzyme by this aryl boronic acid.

The present model is:

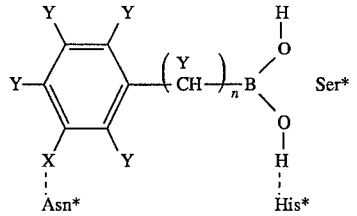

Without meaning to be bound by theory, it is believed that the three bonds formed (at serine, histidine, and asparagine) with the proteolytic enzyme are the reason 3-substituted aryl boronic acid is a superior reversible inhibitor of proteolytic enzyme.

Inhibition constants are usually used as indicators of the strength of the boronic acid to proteolytic enzyme bond. Ki's for the inhibition of subtilisin by boronic acid have been published by Phillip & Bender (cited above). Other serine proteases with the same catalytic site as subtilisin (e.g. BPN', Protease B and chymotrypsin) are expected to be inhibited by boronic acid to the same extent as subtilisin. However, in liquid detergent matrices it has been found herein that inhibition constants cannot be used as predictors of the performance of enzyme inhibitors.

For example, one would predict based on inhibition constants of boronic acids for subtilisin that 4-bromobenzene boronic acid, $K_i$ $1.0\times10^{-5}$, is a better proteolytic enzyme inhibitor than 3-aminobenzene boronic acid, $K_i$ $1.3\times10^{-4}$. However, it has been found that the reverse is true.

The structure of the boronic acid herein is:

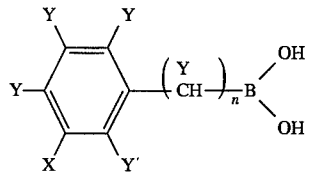

where X is selected from $C_1$–$C_6$ alkyl, substituted $C_1$–$C_6$ alkyl, aryl, substituted aryl, hydroxyl, hydroxyl derivative, amine, $C_1$–$C_6$ alkylated amine, amine derivative, halogen, nitro, thiol, thiol derivative, aldehyde, acid, acid salt, ester, sulfonate or phosphonate; each Y is independently selected from hydrogen, $C_1$–$C_6$ alkyl, substituted $C_1$–$C_6$ alkyl, aryl, substituted aryl, hydroxyl, hydroxyl derivative, halogen, amine, alkylated amine, amine derivative, nitro, thiol, thiol derivative, aldehyde, acid, ester, sulfonate or phosphonate; and n is between 0 and 4.

It is preferred that n is 0 and Y is hydrogen. Y is on any of the carbons in the bridge between boron and the benzene ring.

The aryl boronic acid herein with its 3-position substitution (X) has been found to be a surprisingly superior inhibitor of proteolytic enzyme.

X is preferably hydroxyl, hydroxyl derivative, nitro, amine, alkylated amine, amine derivative, and is more preferably amine, amine derivative, or alkylated amine. Even more preferred are amine derivatives, particularly acetamido ($NHCOCH_3$), and sulfonamido ($NHSO_2CH_3$), and alkylated amine, particularly methylamino ($NHCH_3$). Most preferred is acetamidobenzene boronic acid:

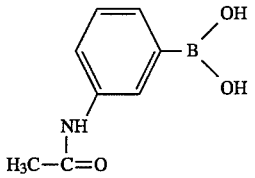

The amine derivatives such as acetamido have been found in this context to be stable to hydrolysis and oxidation in product, and colorless and effective in inhibiting proteolytic enzyme. Therefore they do not impart undesirable color to the composition unlike the parent amine.

In the present liquid detergent composition, from about 0.001 to 10, preferably about 0.02 to 5, most preferably 0.05 to 2, weight % of this 3-substituted aryl boronic acid is preferred. The amount of this aryl boronic acid will vary where detergency builder is present in the composition. Higher levels of this aryl boronic acid should be used with higher builder levels.

B. Proteolytic Enzyme

A second essential ingredient in the present liquid detergent compositions is from about 0.0001 to 1.0, preferably about 0.0005 to 0.5, most preferably about 0.002 to 0.1, weight % of active proteolytic enzyme. Mixtures of proteolytic enzyme are also included. The proteolytic enzyme can be of animal, vegetable or microorganism (preferred) origin. More preferred is serine proteolytic enzyme of bacterial origin. Purified or nonpurified forms of this enzyme may be used. Proteolytic enzymes produced by chemically or genetically modified mutants are included by definition, as are close structural enzyme variants. Particularly preferred is bacterial serine proteolytic enzyme obtained from *Bacillus subtilis* and/or *Bacillus licheniformis*.

Suitable proteolytic enzymes include Alcalase®, Esperase®, Savinase® (preferred); Maxatase®, Maxacal® (preferred), and Maxapem 15® (protein engineered Maxacal®); and subtilisin BPN and BPN' (preferred); which are commercially available. Preferred proteolytic enzymes are also modified bacterial serine proteases, such as those described in European Patent Application Serial Number 87 303761.8, filed Apr. 28, 1987 (particularly pages 17, 24 and 98), and which is called herein "Protease B", and in European Patent Application 199,404, Venegas, published Oct. 29, 1986, which refers to a modified bacterial serine proteolytic enzyme which is called "Protease A" herein. Preferred proteolytic enzymes, then, are selected from the group consisting of Savinase®, Maxacal®, BPN', Protease A and Protease B, and mixtures thereof. Protease B is most preferred.

C. Second Enzyme

The third essential ingredient in the present liquid compositions is a performance-enhancing amount of a detergent-compatible second enzyme. By "detergent-compatible" is meant compatibility with the other ingredients of a liquid detergent composition, such as detersive surfactant and detergency builder. These second enzymes are preferably selected from the group consisting of lipase, amylase, cellulase, and mixtures thereof. The term "second enzyme" excludes the proteolytic enzymes discussed above, so each composition herein contains at least two kinds of enzyme, including at least one proteolytic enzyme.

The amount of second enzyme used in the composition varies according to the type of enzyme and the use intended. In general, from about 0.0001 to 1.0, more preferably 0.001 to 0.5, weight % on an active basis of these second enzymes are preferably used.

Mixtures of enzymes from the same class (e.g. lipase) or two or more classes (e.g. cellulase and lipase) may be used. Purified or non-purified forms of the enzyme may be used.

Any lipase suitable for use in a liquid detergent composition can be used herein. Suitable lipases for use herein include those of bacterial and fungal origin. Second enzymes from chemically or genetically modified mutants are included.

Suitable bacterial lipases include those produced by Pseudomonas, such as *Pseudomonas stutzeri* ATCC 19.154, as disclosed in British Patent 1,372,034, incorporated herein by reference. Suitable lipases include those which show a positive immunological cross-reaction with the antibody of the lipase produced by the microorganism *Pseudomonas fluorescens* IAM 1057. This lipase and a method for its purification have been described in Japanese Patent Application 53–20487, laid open on Feb. 24, 1978, which is incorporated herein by reference. This lipase is available under the trade name Lipase P "Amano," hereinafter referred to as "Amano-P." Such lipases should show a positive immunological cross reaction with the Amano-P antibody, using the standard and well-known immunodiffusion procedure according to Ouchterlony (Acta. Med. Scan., 133, pages 76–79 (1950)). These lipases, and a method for their immunological cross-reaction with Amano-P, are also described in U.S. Pat. No. 4,707,291, Thom et al., issued Nov. 17, 1987, incorporated herein by reference. Typical examples thereof are the Amano-P lipase, the lipase ex *Pseudomonas fragi* FERM P 1339 (available under the trade name Amano-B), lipase ex *Psuedomonas nitroreducens* var. *lipolyticum* FERM P 1338 (available under the trade name Amano-CES), lipases ex *Chromobacter viscosum*, e.g. *Chromobacter viscosum* var. *lipolyticum NRRLB* 3673, and further *Chromobacter viscosum* lipases, and lipases ex *Pseudomonas gladioli*. Other lipases of interest are Amano AKG and Bacillis Sp lipase (e.g., Solvay enzymes).

Other lipases which are of interest where they are detergent-compatible are those described in EP A 0 399 681, published Nov. 28, 1990, EP A 0 385 401, published Sep. 5, 1990, EP A 0 218 272, published Apr. 15, 1987, and PCT/DK 88/00177, published May 18, 1989, all incorporated herein by reference.

Suitable fungal lipases include those producible by *Humicola lanuginosa* and *Thermomyces lanuginosus*. Most preferred is lipase obtained by cloning the gene from *Humicola lanuginosa* and expressing the gene in *Aspergillus oryzae* as described in European Patent Application 0 258 068, incorporated herein by reference, commercially available under the trade name Lipolase®.

From about 2 to 20,000, preferably about 10 to 6,000, lipase units of lipase per gram (LU/g) of product can be used in these compositions. A lipase unit is that amount of lipase which produces 1 μmol of titratable butyric acid per minute in a pH stat, where pH is 7.0, temperature is 30° C., and substrate is an emulsion tributyrin and gum arabic, in the presence of $Ca^{++}$ and NaCl in phosphate buffer.

Any cellulase suitable for use in a liquid detergent composition can be used in these compositions. Suitable cellulase enzymes for use herein include those of bacterial and fungal origins. Preferably, they will have a pH optimum of between 5 and 9.5. From about 0.0001 to 1.0, preferably 0.001 to 0.5, weight % on an active enzyme basis of cellulase can be used.

Suitable cellulases are disclosed in U.S. Pat. No. 4,435,307, Barbesgaard et al., issued Mar. 6, 1984, incorporated herein by reference, which discloses fungal cellulase produced from *Humicola insolens*. Suitable cellulases are also disclosed in GB-A-2.075.028, GB-A-2.095.275 and DE-OS-2.247.832.

Examples of such cellulases are cellulases produced by a strain of *Humicola insolens* (*Humicola grisea* var. *thermoidea*), particularly the Humicola strain DSM 1800, and cellulases produced by a fungus of Bacillus N or a cellulase 212-producing fungus belonging to the genus Aeromonas, and cellulase extracted from the hepatopancreas of a marine mollusc (Dolabella Auricula Solander).

Any amylase suitable for use in a liquid detergent composition can be used in these compositions. Amylases include, for example, α-amylases obtained from a special strain of *B. licheniforms*, described in more detail in British Patent Specification No. 1,296,839. Amylolytic proteins include, for example, Rapidase™, Maxamyl™ and Termamyl™.

From about 0.0001% to 1.0, preferably 0.0005 to 0.5, weight % on an active enzyme basis of amylase can be used.

D. Detersive Surfactant

From about 1 to 80, preferably about 5 to 50, most preferably about 10 to 30, weight % of detersive surfactant is the fourth essential ingredient in the present invention. The detersive surfactant can be selected from the group consisting of anionics, nonionics, cationics, ampholytics, zwitterionics, and mixtures thereof. Anionic and nonionic surfactants are preferred.

The benefits of the present invention are especially pronounced in compositions containing ingredients that are harsh to enzymes such as certain detergency builders and surfactants. Preferably the anionic surfactant comprises $C_{12}$–$C_{20}$ alkyl sulfate, $C_{12}$ to $_{20}$ alkyl ether sulfate and $C_9$ to $_{20}$ linear alkylbenzene sulfonate. Suitable surfactants are described below.

Heavy duty liquid laundry detergents are the preferred liquid detergent compositions herein. The particular surfactants used can vary widely depending upon the particular end-use envisioned. These compositions will most commonly be used for cleaning of laundry, fabrics, textiles, fibers, and hard surfaces.

Anionic Surfactants

One type of anionic surfactant which can be utilized is alkyl ester sulfonates. These are desirable because they can be made with renewable, non-petroleum resources. Preparation of the alkyl ester sulfonate surfactant component is according to known methods disclosed in the technical literature. For instance, linear esters of $C_8$–$C_{20}$ carboxylic acids can be sulfonated with gaseous $SO_3$ according to "The Journal of the American Oil Chemists Society," 52 (1975), pp. 323–329. Suitable starting materials would include natural fatty substances as derived from tallow, palm, and coconut oils, etc.

The preferred alkyl ester sulfonate surfactant, especially for laundry applications, comprises alkyl ester sulfonate surfactants of the structural formula:

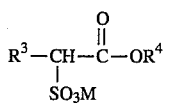

wherein $R^3$ is a $C_8$–$C_{20}$ hydrocarbyl, preferably an alkyl, or combination thereof, $R^4$ is a $C_1$–$C_6$ hydrocarbyl, preferably an alkyl, or combination thereof, and M is a soluble salt-forming cation. Suitable salts include metal salts such as sodium, potassium, and lithium salts, and substituted or unsubstituted ammonium salts, such as methyl-, dimethyl, -trimethyl, and quaternary ammonium cations, e.g. tetramethyl-ammonium and dimethyl piperydinium, and cations derived from alkanolamines, e.g. monoethanolamine, diethanolamine, and triethanolamine. Preferably, $R^3$ is $C_{10}$–$C_{16}$ alkyl, and $R^4$ is methyl, ethyl or isopropyl. Especially preferred are the methyl ester sulfonates wherein $R^3$ is $C_{14}$–$C_{16}$ alkyl.

Alkyl sulfate surfactants are another type of anionic surfactant of importance for use herein. In addition to providing excellent overall cleaning ability when used in combination with polyhydroxy fatty acid amides (see below), including good grease/oil cleaning over a wide range of temperatures, wash concentrations, and wash times, dissolution of alkyl sulfates can be obtained, as well as improved formulability in liquid detergent formulations are water soluble salts or acids of the formula $ROSO_3M$ wherein R preferably is a $C_{10}$–$C_{24}$ hydrocarbyl, preferably an alkyl or hydroxyalkyl having a $C_{10}$–$C_{20}$ alkyl component, more preferably a $C_{12}$–$C_{18}$ alkyl or hydroxyalkyl, and M is H or a cation, e.g., an alkali metal cation (e.g., sodium, potassium, lithium), substituted or unsubstituted ammonium cations such as methyl-, dimethyl-, and trimethyl ammonium and quaternary ammonium cations, e.g., tetramethyl-ammonium and dimethyl piperdinium, and cations derived from alkanolamines such as ethanolamine, diethanolamine, triethanolamine, and mixtures thereof, and the like. Typically, alkyl chains of $C_{12-16}$ are preferred for lower wash temperatures (e.g., below about 50° C.) and $C_{16-18}$ alkyl chains are preferred for higher wash temperatures (e.g., above about 50° C.).

Alkyl alkoxylated sulfate surfactants are another category of useful anionic surfactant. These surfactants are water soluble salts or acids typically of the formula $RO(A)_mSO_3M$ wherein R is an unsubstituted $C_{10}$–$C_{24}$ alkyl or hydroxyalkyl group having a $C_{10}$–$C_{24}$ alkyl component, preferably a $C_{12}$–$C_{20}$ alkyl or hydroxyalkyl, more preferably $C_{12}$–$C_{18}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethyl-ammonium and quaternary ammonium cations, such as tetramethyl-ammonium, dimethyl piperydinium and cations derived from alkanolamines, e.g. monoethanolamine, diethanolamine, and triethanol amine, and mixtures thereof. Exemplary surfactants are $C_{12}$–$C_{18}$ alkyl polyethoxylate (1.0) sulfate, $C_{12}$–$C_{18}$ alkyl polyethoxylate (2.25) sulfate, $C_{12}$–$C_{18}$ alkyl polyethoxylate (3.0) sulfate, and $C_{12}$–$C_{18}$ alkyl polyethoxylate (4.0) sulfate wherein M is conveniently selected from sodium and potassium.

Other Anionic Surfactants

Other anionic surfactants useful for detersive purposes can also be included in the compositions hereof. These can include salts (including, for example, sodium, potassium, ammonium, and substituted ammonium salts such as mono-, di- and triethanolamine salts) of soap, $C_9$–$C_{20}$ linear alkylbenzenesulphonates, $C_8$–$C_{22}$ primary or secondary alkanesulphonates, $C_8$–$C_{24}$ olefinsulphonates, sulphonated polycarboxylic acids prepared by sulphonation of the pyrolyzed product of alkaline earth metal citrates, e.g., as described in British Patent Specification No. 1,082,179, alkyl glycerol sulfonates, fatty acyl glycerol sulfonates, fatty oleyl glycerol sulfates, alkyl phenol ethylene oxide ether sulfates, paraffin sulfonates, alkyl phosphates, isothionates such as the acyl isothionates, N-acyl taurates, fatty acid amides of methyl tauride, alkyl succinamates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), N-acyl sarcosinates, sulfates of alkylpolysaccharides such as the sulfates of alkylpolyglucoside (the nonionic nonsulfated compounds being described below), branched primary alkyl sulfates, alkyl polyethoxy carboxylates such as those of the formula $RO(CH_2CH_2O)_kCH_2COO^-M^+$ wherein R is a $C_8$–$C_{22}$ alkyl, k is an integer from 0 to 10, and M is a soluble salt-forming cation, and fatty acids esterified with isethionic acid and neutralized with sodium hydroxide. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23 (herein incorporated by reference).

Nonionic Detergent Surfactants

Suitable nonionic detergent surfactants are generally disclosed in U.S. Pat. No. 3,929,678, Laughlin et al., issued Dec. 30, 1975, at column 13, line 14 through column 16, line 6, incorporated herein by reference. Exemplary, non-limiting classes of useful nonionic surfactants are listed below.

1. The polyethylene, polypropylene, and polybutylene oxide condensates of alkyl phenols. In general, the polyethylene oxide condensates are preferred. These compounds include the condensation products of alkyl phenols having an alkyl group containing from about 6 to about 12 carbon atoms in either a straight chain or branched chain configuration with the alkylene oxide. In a preferred embodiment, the ethylene oxide is present in an amount equal to from about 5 to about 25 moles of ethylene oxide per mole of alkyl phenol. Commercially available nonionic surfactants of this type include Igepal™ CO-630, marketed by the GAF Corporation; and Triton™ X-45, X-114, X-100, and X-102, all marketed by the Rohm & Haas Company. These compounds are commonly referred to as alkyl phenol alkoxylates, (e.g., alkyl phenol ethoxylates).

2. The condensation products of aliphatic alcohols with from about 1 to about 25 moles of ethylene oxide. The alkyl chain of the aliphatic alcohol can either be straight or branched, primary or secondary, and generally contains from about 8 to about 22 carbon atoms. Particularly preferred are the condensation products of alcohols having an alkyl group containing from about 10 to about 20 carbon atoms with from about 2 to about 18 moles of ethylene oxide per mole of alcohol. Examples of commercially available nonionic surfactants of this type include Tergitol™ 15-S-9 (the condensation product of $C_{11}$–$C_{15}$ linear secondary alcohol with 9 moles ethylene oxide), Tergitol™ 24-L-6 NMW (the condensation product of $C_{12}$–$C_{14}$ primary alcohol with 6 moles ethylene oxide with a narrow molecular weight distribution), both marketed by Union Carbide Corporation; Neodol™ 45–9 (the condensation product of $C_{14}$–$C_{15}$ linear alcohol with 9 moles of ethylene oxide), Neodol™ 23–6.5 (the condensation product of $C_{12}$–$C_{13}$ linear alcohol with 6.5 moles of ethylene oxide), Neodol™ 45–7 (the condensation product of $C_{14}$–$C_{15}$ linear alcohol with 7 moles of ethylene oxide), Neodol™ 45–4 (the condensation product of $C_{14}$–$C_{15}$ linear alcohol with 4 moles of ethylene oxide), marketed by Shell Chemical Company, and Kyro™ EOB (the condensation product of $C_{13}$–$C_{15}$ alcohol with 9 moles ethylene oxide), marketed by The Procter & Gamble Company. This category of nonionic surfactant is referred to generally as "alkyl ethoxylates."

3. The condensation products of ethylene oxide with a hydrophobic base formed by the condensation of propylene oxide with propylene glycol. The hydrophobic portion of these compounds preferably has a molecular weight of from about 1500 to about 1800 and exhibits water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to about 40 moles of ethylene oxide. Examples of compounds of this type include certain of the commercially-available Pluronic™ surfactants, marketed by BASF.

4. The condensation products of ethylene oxide with the product resulting from the reaction of propylene oxide and ethylenediamine. The hydrophobic moiety of these products consists of the reaction product of ethylenediamine and excess propylene oxide, and generally has a molecular weight of from about 2500 to about 3000. This hydrophobic moiety is condensed with ethylene oxide to the extent that the condensation product contains from about 40% to about 80% by weight of polyoxyethylene and has a molecular weight of from about 5,000 to about 11,000. Examples of this type of nonionic surfactant include certain of the commercially available Tetronic™ compounds, marketed by BASF.

5. Semi-polar nonionic surfactants are a special category of nonionic surfactants which include water-soluble amine oxides containing one alkyl moiety of from about 10 to about 18 carbon atoms and 2 moieties selected from the group consisting of alkyl groups and hydroxyalkyl groups containing from about 1 to about 3 carbon atoms; water-soluble phosphine oxides containing one alkyl moiety of from about 10 to about 18 carbon atoms and 2 moieties selected from the group consisting of alkyl groups and hydroxyalkyl groups containing from about 1 to about 3 carbon atoms; and water-soluble sulfoxides containing one alkyl moiety of from about 10 to about 18 carbon atoms and a moiety selected from the group consisting of alkyl and hydroxyalkyl moieties of from about 1 to about 3 carbon atoms.

Semi-polar nonionic detergent surfactants include the amine oxide surfactants having the formula

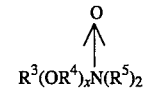

$$R^3(OR^4)_xN(R^5)_2 \rightarrow O$$

wherein $R^3$ is an alkyl, hydroxyalkyl, or alkyl phenyl group or mixtures thereof containing from about 8 to about 22 carbon atoms; $R^4$ is an alkylene or hydroxyalkylene group containing from about 2 to about 3 carbon atoms or mixtures thereof; x is from 0 to about 3; and each $R^5$ is an alkyl or hydroxyalkyl group containing from about 1 to about 3 carbon atoms or a polyethylene oxide group containing from about 1 to about 3 ethylene oxide groups. The $R^5$ groups can be attached to each other, e.g., through an oxygen or nitrogen atom, to form a ring structure.

These amine oxide surfactants in particular include $C_{10}$–$C_{18}$ alkyl dimethyl amine oxides and $C_8$–$C_{12}$ alkoxy ethyl dihydroxy ethyl amine oxides.

6. Alkylpolysaccharides disclosed in U.S. Pat. No. 4,565,647, Llenado, issued Jan. 21, 1986, having a hydrophobic group containing from about 6 to about 30 carbon atoms, preferably from about 10 to about 16 carbon atoms and a polysaccharide, e.g., a polyglycoside, hydrophilic group containing from about 1.3 to about 10, preferably from about 1.3 to about 3, most preferably from about 1.3 to about 2.7 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units.

Optionally, and less desirably, there can be a polyalkyleneoxide chain joining the hydrophobic moiety and the polysaccharide moiety. The preferred alkyleneoxide is ethylene oxide. Typical hydrophobic groups include alkyl groups, either saturated or unsaturated, branched or unbranched containing from about 8 to about 18, preferably from about 10 to about 16, carbon atoms. Preferably, the alkyl group is a straight chain saturated alkyl group. The alkyl group can contain up to about 3 hydroxy groups and/or the polyalkyleneoxide chain can contain up to about 10, preferably less than 5, alkyleneoxide moieties. Suitable alkyl polysaccharides are octyl, nonyldecyl, undecyldodecyl, tridecyl, tetradecyl, pentadecyl, hexadecyl, heptadecyl, and octadecyl, di-, tri-, tetra-, penta-, and hexaglucosides, galactosides, lactosides, glucoses, fructosides, fructoses and/or galactoses. Suitable mixtures include coconut alkyl, di-, tri-, tetra-, and pentaglucosides and tallow alkyl tetra-, penta-, and hexaglucosides.

The preferred alkylpolyglycosides have the formula $$R^2O(C_nH_{2n}O)_t(\text{glycosyl})_x$$

wherein $R^2$ is selected from the group consisting of alkyl, alkylphenyl, hydroxyalkyl, hydroxyalkylphenyl, and mixtures thereof in which the alkyl groups contain from about 10 to about 18, preferably from about 12 to about 14, carbon atoms; n is 2 or 3, preferably 2; t is from 0 to about 10, preferably 0; and x is from about 1.3 to about 10, preferably from about 1.3 to about 3, most preferably from about 1.3 to about 2.7. The glycosyl is preferably derived from glucose. To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-, 3-, 4-and/or 6-position, preferably predominately the 2-position.

7. Fatty acid amide surfactants having the formula:

$$R^6-\overset{\overset{\displaystyle O}{\|}}{C}-N(R^7)_2$$

wherein $R^6$ is an alkyl group containing from about 7 to about 21 (preferably from about 9 to about 17) carbon atoms and each $R^7$ is selected from the group consisting of hydrogen, $C_1$–$C_4$ alkyl, $C_1$–$C_4$ hydroxyalkyl, and $-(C_2H_4O)_xH$ where x varies from about 1 to about 3.

Preferred amides are $C_8$–$C_{20}$ ammonia amides, monoethanolamides, diethanolamides, and isopropanolamides.

Cationic Surfactants

Cationic detersive surfactants can also be included in detergent compositions of the present invention. Cationic surfactants include the ammonium surfactants such as alkyldimethylammonium halogenides, and those surfactants having the formula:

$$[R^2(OR^3)_y][R^4(OR^3)_y]_2R^5N^+X^-$$

wherein $R^2$ is an alkyl or alkyl benzyl group having from about 8 to about 18 carbon atoms in the alkyl chain, each $R^3$ is selected from the group consisting of $-CH_2CH_2-$, $-CH_2CH(CH_3)-$, $-CH_2CH(CH_2OH)-$, $-CH_2CH_2CH_2-$, and mixtures thereof; each $R^4$ is selected from the group consisting of $C_1$–$C_4$ alkyl, $C_1$–$C_4$ hydroxyalkyl, benzyl, ring structures formed by joining the two $R^4$groups, $-CH_2CHOH-CHOHCOR^6CHOHCH_2OH$ wherein $R^6$ is any hexose or hexose polymer having a molecular weight less than about 1000, and hydrogen when y is not 0; $R^5$ is the same as $R^4$ or is an alkyl chain wherein the total number of carbon atoms of $R^2$ plus $R^5$ is not more than about 18; each y is from 0 to about 10 and the sum of the y values is from 0 to about 15; and X is any compatible anion.

Other cationic surfactants useful herein are also described in U.S. Pat. No. 4,228,044, Cambre, issued Oct. 14, 1980, incorporated herein by reference.

Other Surfactants

Ampholytic surfactants can be incorporated into the detergent compositions hereof. These surfactants can be broadly described as aliphatic derivatives of secondary or tertiary amines, or aliphatic derivatives of heterocyclic secondary and tertiary amines in which the aliphatic radical can be straight chain or branched. One of the aliphatic substituents contains at least about 8 carbon atoms, typically from about 8 to about 18 carbon atoms, and at least one contains an anionic water-solubilizing group, e.g., carboxy, sulfonate, sulfate. See U.S. Pat. No. 3,929,678 to Laughlin et al., issued Dec. 30, 1975 at column 19, lines 18–35 (herein incorporated by reference) for examples of ampholytic surfactants.

Zwitterionic surfactants can also be incorporated into the detergent compositions hereof. These surfactants can be broadly described as derivatives of secondary and tertiary amines, derivatives of heterocyclic secondary and tertiary amines, or derivatives of quaternary ammonium, quaternary phosphonium or tertiary sulfonium compounds. See U.S. Pat. No. 3,929,678 to Laughlin et al., issued Dec. 30, 1975 at column 19, line 38 through column 22, line 48 (herein incorporated by reference) for examples of zwitterionic surfactants.

Ampholytic and zwitterionic surfactants are generally used in combination with one or more anionic and/or nonionic surfactants.

Polyhydroxy Fatty Acid Amide Surfactant

The liquid detergent compositions hereof preferably contain an "enzyme performance-enhancing amount" of polyhydroxy fatty acid amide surfactant. By "enzyme-enhancing" is meant that the formulator of the composition can select an amount of polyhydroxy fatty acid amide to be incorporated into the composition that will improve enzyme cleaning performance of the detergent composition. In general, for conventional levels of enzyme, the incorporation of about 1%, by weight, polyhydroxy fatty acid amide will enhance enzyme performance.

The detergent compositions hereof will typically comprise at least about 1 weight % polyhydroxy fatty acid amide surfactant and preferably will comprise from about 3% to 50%, most preferably from about 3% to 30%, of the polyhydroxy fatty acid amide.

The polyhydroxy fatty acid amide surfactant component comprises compounds of the structural formula:

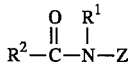

(I)

wherein: $R^1$ is H, $C_1$–$C_4$ hydrocarbyl, 2-hydroxy ethyl, 2-hydroxy propyl, or a mixture thereof, preferably $C_1$–$C_4$ alkyl, more preferably $C_1$ or $C_2$ alkyl, most preferably $C_1$ alkyl (i.e., methyl); and $R^2$ is a $C_5$–$C_{31}$ hydrocarbyl, preferably straight chain $C_7$–$C_{19}$ alkyl or alkenyl, more preferably straight chain $C_9$–$C_{17}$ alkyl or alkenyl, most preferably straight chain $C_{11}$–$C_{15}$ alkyl or alkenyl, or mixtures thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z will be a glycityl. Suitable reducing sugars include glucose, fructose, maltose, lactose, galactose, mannose, and xylose. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of $—CH_2—(CHOH)_n—CH_2OH$, $—CH(CH_2OH)—(CHOH)_{n-1}—CH_2OH$, $—CH_2—(CHOH)_2(CHOR')(CHOH)—CH_2OH$, and alkoxylated derivatives thereof, where n is an integer from 3 to 5, inclusive, and R' is H or a cyclic or aliphatic monosaccharide. Most preferred are glycityls wherein n is 4, particularly $—CH_2(CHOH)_4—CH_2OH$.

In Formula (I), R' can be, for example, N-methyl, N-ethyl, N-propyl, N-isopropyl, N-butyl, N-2-hydroxy ethyl, or N-2-hydroxy propyl.

$R^2$—CO—N< can be, for example, cocamide, stearamide, oleamide, lauramide, myristamide, capricamide, palmitamide, tallowamide, etc.

Z can be 1-deoxyglucityl, 2-deoxyfructityl, 1-deoxymaltityl, 1-deoxylactityl, 1-deoxygalactityl, 1-deoxymannityl, 1-deoxymaltotriotityl, etc.

Methods for making polyhydroxy fatty acid amides are known in the art. In general, they can be made by reacting an alkyl amine with a reducing sugar in a reductive amination reaction to form a corresponding N-alkyl polyhydroxyamine, and then reacting the N-alkyl polyhydroxyamine with a fatty aliphatic ester or triglyceride in a condensation/amidation step to form the N-alkyl, N-polyhydroxy fatty acid amide product. Processes for making compositions containing polyhydroxy fatty acid amides are disclosed, for example, in G.B. Patent Specification 809,060, published Feb. 18, 1959, U.S. Pat. No. 2,965,576, issued Dec. 20, 1960 to E. R. Wilson, and U.S. Pat. No. 2,703,798, Anthony M. Schwartz, issued March 8, 1955, and U.S. Pat. No. 1,985,424, issued Dec. 25, 1934 to Piggott, each of which is incorporated herein by reference.

E. Optional Ingredients

Detergency Builders

From 0 to about 50, preferably about 3 to 30, more preferably about 5 to 20, weight % detergency builder can be included herein. Inorganic as well as organic builders can be used.

Inorganic detergency builders include, but are not limited to, the alkali metal, ammonium and alkanolammonium salts of polyphosphates (exemplified by the tripolyphosphates, pyrophosphates, and glassy polymeric meta-phosphates), phosphonates, phytic acid, silicates, carbonates (including bicarbonates and sesquicarbonates), sulphates, and aluminosilicates. Borate builders, as well as builders containing borate-forming materials that can produce borate under detergent storage or wash conditions (hereinafter, collectively "borate builders"), can also be used. Preferably, non-borate builders are used in the compositions of the invention intended for use at wash conditions less than about 50° C., especially less than about 40° C.

Examples of silicate builders are the alkali metal silicates, particularly those having a $SiO_2$:$Na_2O$ ratio in the range 1.6:1 to 3.2:1 and layered silicates, such as the layered sodium silicates described in U.S. Pat. No. 4,664,839, issued May 12, 1987 to H. P. Rieck, incorporated herein by reference. However, other silicates may also be useful such as for example magnesium silicate, which can serve as a crispening agent in granular formulations, as a stabilizing agent for oxygen bleaches, and as a component of suds control systems.

Examples of carbonate builders are the alkaline earth and alkali metal carbonates, including sodium carbonate and sesquicarbonate and mixtures thereof with ultra-fine calcium carbonate as disclosed in German Patent Application No. 2,321,001 published on Nov. 15, 1973, the disclosure of which is incorporated herein by reference.

Aluminosilicate builders are useful in the present invention. Aluminosilicate builders are of great importance in most currently marketed heavy duty granular detergent compositions, and can also be a significant builder ingredient in liquid detergent formulations. Aluminosilicate builders include those having the empirical formula:

$$M_z(zAlO_2.ySiO_2)$$

wherein M is sodium, potassium, ammonium or substituted ammonium, z is from about 0.5 to about 2; and y is 1; this material having a magnesium ion exchange capacity of at least about 50 milligram equivalents of $CaCO_3$ hardness per gram of anhydrous aluminosilicate. Preferred aluminosilicates are zeolite builders which have the formula:

$$Na_z[(AlO_2)_z(SiO_2)_y].xH_2O$$

wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel, et al., issued Oct. 12, 1976, incorporated herein by reference. Preferred synthetic crystalline aluminosilicate ion exchange materials useful herein are available under the designations Zeolite A, Zeolite P (B), and Zeolite X. In an especially preferred embodiment, the crystalline aluminosilicate ion exchange material has the formula:

$$Na_{12}[(AlO_2)_{12}(SiO_2)_{12}].xH_2O$$

wherein x is from about 20 to about 30, especially about 27. This material is known as Zeolite A. Preferably, the aluminosilicate has a particle size of about 0.1–10 microns in diameter.

Specific examples of polyphosphates are the alkali metal tripolyphosphates, sodium, potassium and ammonium pyrophosphate, sodium and potassium and ammonium pyrophosphate, sodium and potassium orthophosphate, sodium polymeta phosphate in which the degree of polymerization ranges from about 6 to about 21, and salts of phytic acid.

Examples of phosphonate builder salts are the water-soluble salts of ethane 1-hydroxy-1, 1-diphosphonate particularly the sodium and potassium salts, the water-soluble salts of methylene diphosphonic acid e.g. the trisodium and tripotassium salts and the water-soluble salts of substituted methylene diphosphonic acids, such as the trisodium and tripotassium ethylidene, isopyropylidene benzylmethylidene and halo methylidene phosphonates. Phosphonate builder salts of the aforementioned types are disclosed in U.S. Pat. Nos. 3,159,581 and 3,213,030 issued Dec. 1, 1964 and Oct. 19, 1965, to Diehl; U.S. Pat. No. 3,422,021 issued Jan. 14, 1969, to Roy; and U.S. Pat. Nos. 3,400,148 and 3,422,137 issued Sep. 3, 1968, and Jan. 14, 1969 to Quimby, said disclosures being incorporated herein by reference.

Organic detergent builders preferred for the purposes of the present invention include a wide variety of polycarboxylate compounds. As used herein, "polycarboxylate" refers to compounds having a plurality of carboxylate groups, preferably at least 3 carboxylates.

Polycarboxylate builder can generally be added to the composition in acid form, but can also be added in the form of a neutralized salt. When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates. A number of ether polycarboxylates have been disclosed for use as detergent builders. Examples of useful ether polycarboxylates include oxydisuccinate, as disclosed in Berg, U.S. Pat. No. 3,128,287, issued Apr. 7, 1964, and Lamberti et al., U.S. Pat. No. 3,635,830, issued Jan. 18, 1972, both of which are incorporated herein by reference.

A specific type of ether polycarboxylates useful as builders in the present invention also include those having the general formula:

$$CH(A)(COOX)—CH(COOX)—O—CH(COOX)—CH(COOX)(B)$$

wherein A is H or OH; B is H or —O—CH(COOX)—$CH_2$(COOX); and X is H or a salt-forming cation. For example, if in the above general formula A and B are both H, then the compound is oxydissuccinic acid and its water-soluble salts. If A is OH and B is H, then the compound is tartrate monosuccinic acid (TMS) and its water-soluble salts. If A is H and B is —O—CH(COOX)—$CH_2$(COOX), then the compound is tartrate disuccinic acid (TDS) and its water-soluble salts. Mixtures of these builders are especially preferred for use herein. Particularly preferred are mixtures of TMS and TDS in a weight ratio of TMS to TDS of from about 97:3 to about 20:80. These builders are disclosed in U.S. Pat. No. 4,663,071, issued to Bush et al., on May 5, 1987.

Suitable ether polycarboxylates also include cyclic compounds, particularly alicyclic compounds, such as those described in U.S. Pat. Nos. 3,923,679; 3,835,163; 4,158,635; 4,120,874 and 4,102,903, all of which are incorporated herein by reference.

Other useful detergency builders include the ether hydroxypolycarboxylates represented by the structure:

$$HO—[C(R)(COOM)—C(R)(COOM)—O]_n—H$$

wherein M is hydrogen or a cation wherein the resultant salt is water-soluble, preferably an alkali metal, ammonium or substituted ammonium cation, n is from about 2 to about 15 (preferably n is from about 2 to about 10, more preferably n averages from about 2 to about 4) and each R is the same or different and selected from hydrogen, $C_{1-4}$ alkyl or $C_{1-4}$ substituted alkyl (preferably R is hydrogen ).

Still other ether polycarboxylates include copolymers of maleic anhydride with ethylene or vinyl methyl ether, 1, 3, 5-trihydroxy benzene-2, 4, 6-trisulphonic acid, and carboxymethyloxysuccinic acid.

Organic polycarboxylate builders also include the various alkali metal, ammonium and substituted ammonium salts of polyacetic acids. Examples include the sodium, potassium, lithium, ammonium and substituted ammonium salts of ethylenediamine tetraacetic acid, and nitrilotriacetic acid.

Also included are polycarboxylates such as mellitic acid, succinic acid, oxydisuccinic acid, polymaleic acid, benzene 1,3,5-tricarboxylic acid, and carboxymethyloxysuccinic acid, and soluble salts thereof.

Citrate builders, e.g., citric acid and soluble salts thereof (particularly sodium salt), are polycarboxylate builders of particular importance for heavy duty liquid detergent formulations, but can also be used in granular compositions.

Other carboxylate builders include the carboxylated carbohydrates disclosed in U.S. Pat. No. 3,723,322, Diehl, issued Mar. 28, 1973, incorporated herein by reference.

Also suitable in the detergent compositions of the present invention are the 3,3-dicarboxy-4-oxa-1,6-hexanedioates and the related compounds disclosed in U.S. Pat. No. 4,566,984, Bush, issued Jan. 28, 1986, incorporated herein by reference. Useful succinic acid builders include the $C_5$–$C_{20}$ alkyl succinic acids and salts thereof. A particularly preferred compound of this type is dodecenylsuccinic acid. Alkyl succinic acids typically are of the general formula R—CH(COOH)$CH_2$(COOH) i.e., derivatives of succinic acid, wherein R is hydrocarbon, e.g., $C_{10}$–$C_{20}$ alkyl or alkenyl, preferably $C_{12}$–$C_{16}$ or wherein R may be substituted with hydroxyl, sulfo, sulfoxy or sulfone substituents, all as described in the above-mentioned patents.

The succinate builders are preferably used in the form of their water-soluble salts, including the sodium, potassium, ammonium and alkanolammonium salts.

Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0,200,263, published Nov. 5, 1986.

Examples of useful builders also include sodium and potassium carboxymethyloxymalonate, carboxymethyloxysuccinate, cis-cyclohexane-hexacarboxylate, cis-cyclopentane-tetracarboxylate, water-soluble polyacrylates (these polyacrylates having molecular weights to above about 2,000 can also be effecitvly utilized as dispersants), and the copolymers of maleic anhydride with vinyl methyl ether or ethylene.

Other suitable polycarboxylates are the polyacetal carboxylates disclosed in U.S. Pat. No. 4,144,226, Crutchfield et al., issued Mar. 13, 1979, incorporated herein by reference. These polyacetal carboxylates can be prepared by bringing together, under polymerization conditions, an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a surfactant.

Polycarboxylate builders are also disclosed in U.S. Pat. No. 3,308,067, Diehl, issued Mar. 7, 1967, incorporated herein by reference. Such materials include the water-soluble salts of homo- and copolymers of aliphatic carboxylic acids such as maleic acid, itaconic acid, mesaconic acid, fumaric acid, aconitic acid, citraconic acid and methylenemalonic acid.

Other organic builders known in the art can also be used. For example, monocarboxylic acids, and soluble salts thereof, having long chain hydrocarbyls can be utilized. These would include materials generally referred to as "soaps." Chain lengths of $C_{10}$–$C_{20}$ are typically utilized. The hydrocarbyls can be saturated or unsaturated.

Soil Release Agent.

Any soil release agents known to those skilled in the art can be employed in the practice of this invention. Preferred polymeric soil release agents are characterized by having both hydrophilic segments, to hydrophilize the surface of hydrophobic fibers, such as polyester and nylon, and hydrophobic segments, to deposit upon hydrophobic fibers and remain adhered thereto through completion of washing and rinsing cycles and, thus, serve as an anchor for the hydrophilic segments. This can enable stains occurring subsequent to treatment with the soil release agent to be more easily cleaned in later washing procedures.

Whereas it can be beneficial to utilize polymeric soil release agents in any of the detergent compositions hereof, especially those compositions utilized for laundry or other applications wherein removal of grease and oil from hydrophobic surfaces is needed, the presence of polyhydroxy fatty acid amide in detergent compositions also containing anionic surfactants can enhance performance of many of the more commonly utilized types of polymeric soil release agents. Anionic surfactants interfere with the ability of certain soil release agents to deposit upon and adhere to hydrophobic surfaces. These polymeric soil release agents have nonionic hydrophile segments or hydrophobe segments which are anionic surfactant-interactive.

Typical polymeric soil release agents useful in this invention include those having: (a) one or more nonionic hydrophile components consisting essentially of (i) polyoxyethylene segments with a degree of polymerization of at least 2, or (ii) oxypropylene or polyoxypropylene segments with a degree of polymerization of from 2 to 10, wherein said hydrophile segment does not encompass any oxypropylene unit unless it is bonded to adjacent moieties at each end by ether linkages, or (iii) a mixture of oxyalkylene units comprising oxyethylene and from 1 to about 30 oxypropylene units wherein said mixture contains a sufficient amount of oxyethylene units such that the hydrophile component has hydrophilicity great enough to increase the hydrophilicity of conventional polyester synthetic fiber surfaces upon deposit of the soil release agent on such surface, said hydrophile segments preferably comprising at least about 25% oxyethylene units and more preferably, especially for such components having about 20 to 30 oxypropylene units, at least about 50% oxyethylene units; or (b) one or more hydrophobe components comprising (i) $C_3$ oxyalkylene terephthalate segments, wherein, if said hydrophobe components also comprise oxyethylene terephthalate, the ratio of oxyethylene terephthalate:$C_3$ oxyalkylene terephthalate units is about 2:1 or lower, (ii) $C_4$–$C_6$ alkylene or oxy $C_4$–$C_6$ alkylene segments, or mixtures thereof, (iii) poly (vinyl ester) segments, preferably poly(vinyl acetate), having a degree of polymerization of at least 2, or (iv) $C_1$–$C_4$ alkyl ether or $C_4$ hydroxyalkyl ether substituents, or mixtures thereof, wherein said substituents are present in the form of $C_1$–$C_4$ alkyl ether or $C_4$ hydroxyalkyl ether cellulose derivatives, or mixtures thereof, and such cellulose derivatives are amphiphilic, whereby they have a sufficient level of $C_1$–$C_4$ alkyl ether and/or $C_4$ hydroxyalkyl ether units to deposit upon conventional polyester synthetic fiber surfaces and retain a sufficient level of hydroxyls, once adhered to such conventional synthetic fiber surface, to increase fiber surface hydrophilicity, or a combination of (a) and (b).

Useful soil release polymers are described in U.S. Pat. No. 4,000,093, issued Dec. 28, 1976 to Nicol et al., European Patent Application 0 219 048, published Apr. 22, 1987 by Kud et al. U.S. Pat. 3,959,230 to Hays, issued May 25, 1976, U.S. Pat. No. 3,893,929 to Basadur issued Jul. 8, 1975, U.S. Pat. No. 4,702,857, issued Oct. 27, 1987 to Gosselink, U.S. Pat. No. 4,711,730, issued Dec. 8, 1987 to Gosselink et al., U.S. Pat. No. 4,721,580, issued Jan. 26, 1988 to Gosselink, U.S. Pat. No. 4,702,857, issued Oct. 27, 1987 to Gosselink, U.S. Pat. No. 4,877,896, issued Oct. 31, 1989 to Maldonado et al. All of these patents are incorporated herein by reference.

If utilized, soil release agents will generally comprise from about 0.01% to about 10.0%, by weight, of the detergent compositions herein, typically from about 0.1% to about 5%, preferably from about 0.2% to about 3.0%.

Chelating Agents

The detergent compositions herein may also optionally contain one or more iron and manganese chelating agents as a builder adjunct material. Such chelating agents can be selected from the group consisting of amino carboxylates, amino phosphonates, polyfunctionally-substituted aromatic chelating agents and mixtures thereof, all as hereinafter defined. Without intending to be bound by theory, it is believed that the benefit of these materials is due in part to their exceptional ability to remove iron and manganese ions from washing solutions by formation of soluble chelates.

Amino carboxylates useful as optional chelating agents in compositions of the invention can have one or more, preferably at least two, units of the substructure

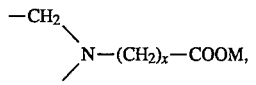

wherein M is hydrogen, alkali metal, ammonium or substituted ammonium (e.g. ethanolamine) and x is from 1 to about 3, preferably 1. Preferably, these amino carboxylates do not contain alkyl or alkenyl groups with more than about 6 carbon atoms. Operable amine carboxylates include ethylenediaminetetraacetates, N-hydroxyethylethylenediaminetriacetates, nitrilotriacetates, ethylenediamine tetrapropionates, triethylenetetraaminehexaacetates, diethylenetriaminepentaacetates, and ethanoldiglycines, alkali metal, ammonium, and substituted ammonium salts thereof and mixtures thereof.

Amino phosphonates are also suitable for use as chelating agents in the compositions of the invention when at least low levels of total phosphorus are permitted in detergent compositions. Compounds with one or more, preferably at least two, units of the substructure

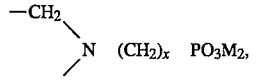

wherein M is hydrogen, alkali metal, ammonium or substituted ammonium and x is from 1 to about 3, preferably 1, are useful and include ethylenediaminetetrakis (methylenephosphonates), nitrilotris (methylenephosphonates) and diethylenetriaminepentakis (methylenephosphonates). Preferably, these amino phosphonates do not contain alkyl or alkenyl groups with more than about 6 carbon atoms. Alkylene groups can be shared by substructures.

Polyfunctionally-substituted aromatic chelating agents are also useful in the compositions herein. These materials can comprise compounds having the general formula

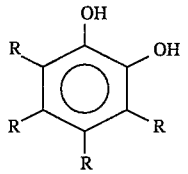

wherein at least one R is —$SO_3H$ or —COOH or soluble salts thereof and mixtures thereof. U.S. Pat. No. 3,812,044, issued May 21, 1974, to Connor et al., incorporated herein by reference, discloses polyfunctionally-substituted aromatic chelating and sequestering agents. Preferred compounds of this type in acid form are dihydroxydisulfobenzenes such as 1,2-dihydroxy -3,5-disulfobenzene. Alkaline detergent compositions can contain these materials in the form of alkali metal, ammonium or substituted ammonium (e.g. mono-or triethanol-amine) salts.

If utilized, these chelating agents will generally comprise from about 0.1% to about 10% by weight of the detergent compositions herein. More preferably chelating agents will comprise from about 0.1% to about 3.0% by weight of such compositions.

Clay Soil Removal/Anti-redeposition Agents

The compositions of the present invention can also optionally contain water-soluble ethoxylated amines having clay soil removal and anti-redeposition properties. Liquid detergent compositions which contain these compounds typically contain from about 0.01% to 5%.

The most preferred soil release and anti-redeposition agent is ethoxylated tetraethylenepentamine. Exemplary ethoxylated amines are further described in U.S. Pat. No. 4,597,898, VanderMeer, issued Jul. 1, 1986, incorporated herein by reference. Another group of preferred clay soil removal/anti-redeposition agents are the cationic compounds disclosed in European Patent Application 11,965, Oh and Gosselink, published Jun. 27, 1984, incorporated herein by reference. Other clay soil removal/anti-redeposition agents which can be used include the ethoxylated amine polymers disclosed in European Patent Application 111,984, Gosselink, published Jun. 27, 1984; the zwitterionic polymers disclosed in European Patent Application 112,592, Gosselink, published Jul. 4, 1984; and the amine oxides disclosed in U.S. Pat. No. 4,548,744, Connor, issued Oct. 22, 1985, all of which are incorporated herein by reference.

Other clay soil removal and/or anti redeposition agents known in the art can also be utilized in the compositions hereof. Another type of preferred anti-redeposition agent includes the carboxymethylcellulose (CMC) materials. These materials are well known in the art.

Polymeric Dispersing Agents

Polymeric dispersing agents can advantageously be utilized in the compositions hereof. These materials can aid in calcium and magnesium hardness control. Suitable polymeric dispersing agents include polymeric polycarboxylates and polyethylene glycols, although others known in the art can also be used.

Suitable polymeric dispersing agents for use herein are described in U.S. Pat. No. 3,308,067, Diehl, issued Mar. 7, 1967, and European Patent Application No. 66915, published Dec. 15, 1982, both incorporated herein by reference.

Brightener

Any suitable optical brighteners or other brightening or whitening agents known in the art can be incorporated into the detergent compositions hereof.

Commercial optical brighteners which may be useful in the present invention can be classified into subgroups which include, but are not necessarily limited to, derivatives of stilbene, pyrazoline, coumarin, carboxylic acid, methinecyanines, dibenzothiphene-5,5-dioxide, azoles, 5- and 6-membered-ring heterocycles, and other miscellaneous agents. Examples of such brighteners are disclosed in "The Production and Application of Fluorescent Brightening Agents", M. Zahradnik, Published by John Wiley & Sons, New York (1982), the disclosure of which is incorporated herein by reference.

Suds Suppressors

Compounds known, or which become known, for reducing or suppressing the formation of suds can be incorporated into the compositions of the present invention. Suitable suds suppressors are described in Kirk Othmer Encyclopedia of Chemical Technology, Third Edition, Volume 7, pages 430–447 (John Wiley & Sons, Inc., 1979), U.S. Pat. No. 2,954,347, issued Sep. 27, 1960 to St. John, U.S. Pat. No. 4,265,779, issued May 5, 1981 to Gandolfo et al., U.S. Pat. No. 4,265,779, issued May 5, 1981 to Gandolfo et al. and European Pat. No. Application No. 89307851.9, published Feb. 7, 1990, U.S. Pat. No. 3,455,839, German Pat. No. Application DOS 2,124,526, U.S. Pat. No. 3,933,672, Bartolotta et al., and U.S. Pat. No. 4,652,392, Baginski et al., issued Mar. 24, 1987. All are incorporated herein by reference.

The compositions hereof will generally comprise from 0% to about 5% of suds suppressor.

Other Ingredients

A wide variety of other ingredients useful in detergent compositions can be included in the compositions hereof, including other active ingredients, carriers, hydrotropes, processing aids, dyes or pigments, solvents for liquid formulations, bleaches, bleach activators, etc.

Liquid detergent compositions can contain water and other solvents as carriers. Low molecular weight primary or secondary alcohols exemplified by methanol, ethanol, propanol, and isopropanol are suitable. Monohydric alcohols are preferred for solubilizing surfactant, but polyols such as those containing from 2 to about 6 carbon atoms and from 2 to about 6 hydroxy groups (e.g., propylene glycol, ethylene glycol, glycerine, and 1,2-propanediol) can also be used.

Liquid Compositions

Preferred heavy duty liquid laundry detergent compositions hereof will preferably be formulated such that during use in aqueous cleaning operations, the wash water will have a pH of between about 6.5 and 11.0, preferably between about 7.0 and 8.5.

The compositions herein preferably have a pH in a 10% solution in water at 20° C. of between about 6.5 to 11.0, preferably 7.0 to 8.5. Techniques for controlling pH at recommended usage levels include the use of buffers, alkalis, acids, etc., and are well known to those skilled in the art.

This invention further provides a method for cleaning substrate, such as fibers, fabrics, hard surfaces, skin, etc., by contacting said substrate, with a liquid detergent composition comprising detersive surfactant, proteolytic enzyme, a detergent-compatible second enzyme, and the aryl boronic acids described above. Agitation is preferably provided for enhancing cleaning. Suitable means for providing agitation include rubbing by hand or preferably with use of a brush, sponge, cloth, mop, or other cleaning device, automatic laundry washing machines, automatic dishwashers, etc.

Preferred herein are concentrated liquid detergent compositions. By "concentrated" is meant that these compositions will deliver to the wash the same amount of active detersive ingredients at a reduced dosage. Typical regular dosage of heavy duty liquids is 118 milliliters in the U.S. (about ½ cup) and 180 milliliters in Europe.

Concentrated heavy duty liquids herein contain about 10 to 100 weight % more active detersive ingredients than regular heavy duty liquids, and are dosed at less than ½ cup depending upon their active levels. This invention becomes even more useful in concentrated formulations because there are more actives to interfere with enzyme performance. Preferred are heavy duty liquid laundry detergent compositions with from about 30 to 90, preferably 40 to 80, most preferably 50 to 60, weight % of active detersive ingredients.

The following examples illustrate the compositions of the present invention. All parts, percentages and ratios used herein are by weight unless otherwise specified.

EXAMPLES 1–8

A base composition is made as shown below and used in Examples 1–8:

BASE MATRIX 1

| COMPONENT | WT % |
|---|---|
| 1) C14–15 alkyl polyethoxylate (2.25) sulfonic acid | 10.00 |
| 2) C12.3 linear alkylbenzene sulfonic acid | 8.50 |
| 3) C12–13 alkyl polyethoxylate (6.5) | 2.40 |
| 4) Sodium cumene sulfonate | 2.10 |
| 5) Ethanol | 1.19 |
| 6) 1,2 propanediol | 5.00 |
| 7) Sodium hydroxide | 1.90 |
| 8) Monoethanolamine | 2.40 |
| 9) Citric acid | 1.50 |
| 10) C12–14 fatty acid | 1.90 |
| 11) Tetraethylene pentaamine ethoxylate (15–18) | 1.44 |
| 12) Brightener | 0.10 |
| 13) Calcium formate | 0.05 |
| 14) Sodium formate | 0.80 |
| 15) Water/Misc. | 58.49 |
| 16) Polyethoxy terephthalate (MW = 3170) | 0.48 |
| 17) Dye /perfume | 0.25 |
| 18) Ingredients per Examples 1–8 | 1.50 |
| Total | 100.00 |

The components are added in the order shown above. Base Matrix 1 is then used in the formulations shown below:

| | EX 1 WT % | EX 2 WT % | EX 3 WT % |
|---|---|---|---|
| Base Matrix 1 | 98.50 | 98.50 | 98.50 |
| Protease B (34 g/L) | 0.55 | 0.55 | 0.55 |
| Lipase (100,000 LU/g) | 0.75 | 0.75 | 0.75 |
| 4-Bromobenzene boronic acid | 0.20 | — | — |
| 4-Methylbenzene boronic acid | — | 0.20 | — |
| 4-Chlorobenzene boronic acid | — | — | 0.20 |
| TOTAL | 100.00 | 100.00 | 100.00 |
| pH (10% Formulation) | | (7.9–8.5) | |

-continued

| | EX 4 WT % | EX 5 WT % | EX 6 WT % |
|---|---|---|---|
| Base Matrix 1 | 98.50 | 98.50 | 98.50 |
| Protease B (34 g/L) | 0.55 | 0.55 | 0.55 |
| Lipase (100,000 LU/g) | 0.75 | 0.75 | 0.75 |
| Butylboronic Acid | 0.20 | — | — |
| 3-Aminobenzene boronic acid | — | 0.20 | — |
| 3-Dansylaminobenzene boronic acid | — | — | 0.20 |
| TOTAL | 100.00 | 100.00 | 100.00 |
| pH (10% Formulation) | | (7.9–8.3) | |

| | EX 7 WT % | EX 8 WT % |
|---|---|---|
| Base Matrix 1 | 98.50 | 98.50 |
| Protease B (34 g/L) | 0.55 | 0.55 |
| Lipase (100,000 LU/g) | 0.75 | 0.75 |
| 3-Acetamidobenzene boronic acid | 0.20 | — |
| 3-Nitrobenzene boronic acid | — | 0.20 |
| TOTAL | 100.00 | 100.00 |
| pH (10% Formulation) | (7.9–8.5) | |

Method Used to Determine Residual Lipase Activity

Initial lipase activity is measured using a pH-stat computer assisted titrimeter. A titration mixture is prepared using 10 mM calcium chloride ($CaCl_2$), 20mM sodium chloride (NaCl) and 5ram tris buffer at a pH of 8.5–8.8. A commercial lipase substrate containing 5.0 wt % olive oil, and an emulsifier is used. 100 microliters of the detergent composition is added to the mixture. The fatty acids formed by lipase-catalysed hydrolysis are titrated against a standard sodium hydroxide solution. The slope of the titration curve is taken as the measure of lipase activity. Initial activity is measured immediately after the composition is prepared. The samples are then aged at 90° F. (32.2° C.) and the residual activity is measured after two and three weeks of storage at 90° F. The residual activity in Table I below is reported as the percentage of initial activity. The inhibition constant (Ki) is used as a measure of the ability of an inhibitor to inhibit a proteolytic enzyme. The lower the Ki is, the better the inhibition is, according to the literature.

DATA TABLE 1
% REMAINING LIPASE ACTIVITY

| | Ki** | 2 WEEKS | 3 WEEKS |
|---|---|---|---|
| Example 1 | $2.2 \times 10^{-5}$ | 23* | 7 |
| Example 2 | $4.5 \times 10^{-4}$ | 7 | 4 |
| Example 3 | $9.4 \times 10^{-6}$ | 43 | 31 |
| Example 4 | $7.2 \times 10^{-3}$ | 10* | 7 |
| Example 5 | $1.3 \times 10^{-4}$ | 86 | 82 |
| Example 6 | $6.0 \times 10^{-7}$ | 80 | 68 |
| Example 7 | n.a. | 100 | 60 |
| Example 8 | $1.0 \times 10^{-5}$ | 72 | 64 |

*Reading after 11 days.

**For subtilisin from Phillip & Bender article cited above.

CONCLUSION: In liquid detergent compositions, only 3-substituted boronic acids (Examples 5–8), which have a comon structure of:

-continued

DATA TABLE 1
% REMAINING LIPASE ACTIVITY

| Ki** | 2 WEEKS | 3 WEEKS |
|---|---|---|

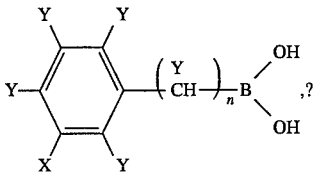

where X, Y and n are as described above, are effective inhibitors of proteolytic enzyme.

Other boronic acids (Examples 1–4) do not provide sufficient stability to lipase. This behavior surprisingly is not predictable from Ki values of these inhibitors for subtilisin type protease, which have been used in the past to predict the effectiveness of the inhibitor. From Kis, one would predict that 3-aminobenzene boronic acid (Example 5) would be inferior to 4-bromobenzene boronic acid (Example 1) or 4-chlorobenzene boronic acid (Example 3). In fact, 3-aminobenzene boronic acid is the most effective aryl boronic acid tested (after 3 weeks of storage at 90° F.; 32.2° C.).

Other compositions of the present invention are obtained when Protease B is substituted with other proteases such as Alcalase®, Savinase® and BPN', and/or lipase is substituted by or used in conjunction with other second enzymes such as amylase.

EXAMPLES 9–14

A concentrated built base composition, shown below, is made and used in Examples 9 –14:

BASE MATRIX 2

| COMPONENT | WT % |
|---|---|
| 1) C14–15 alkyl polyethoxylate (2.25) sulfonic acid | 10.60 |
| 2) C12.3 linear alkylbenzene sulfonic acid | 12.50 |
| 3) C12–13 alkyl polyethoxylate (6.5) | 2.40 |
| 4) Sodium cumene sulfonate | 6.00 |
| 5) Ethanol | 1.47 |
| 6) 1,2 propanediol | 4.00 |
| 7) Sodium hydroxide | 0.30 |
| 8) Monoethanolamine | 1.00 |
| 9) Tetraethylene pentaamine ethoxylate (15–18) | 1.50 |
| 10) C12–14 Fatty acid | 2.00 |
| 11) Water/Misc. | 22.23 |
| 12) Ingredients per Examples 9–14 | 36.00 |
| TOTAL | 100.00 |

The ingredients are added in the order shown above. Base Matrix 2 is then used in the formulations shown below:

| | EX 9 WT % | EX 10 WT % | EX 11 WT % |
|---|---|---|---|
| Base Matrix 2 | 64.00 | 64.00 | 64.00 |
| Sodium tartrate mono- and di-succinate (80:20 mix) | 6.00 | 6.00 | 6.00 |
| Sodium citrate,dihydrate | 6.12 | 6.12 | 6.12 |
| Sodium formate | 0.39 | 0.39 | 0.39 |
| Lipase (100,000 LU/g) | 0.75 | 0.75 | 0.75 |
| Protease B (34 g/L) | 0.70 | 0.70 | 0.70 |
| 1,2 propanediol | 2.00 | 2.00 | 2.00 |
| 4-Bromobenzene boronic acid | 0.50 | — | — |
| 4-Methoxybenzene boronic acid | — | 0.50 | — |
| 4-Chlorobenzene boronic acid | — | — | 0.50 |
| Water | 19.54 | 19.54 | 19.54 |
| TOTAL | 100.00 | 100.00 | 100.00 |
| pH (10% solution) | | (7.8–8.1) | |

| | EX 12 WT % | EX 13 WT % | EX 14 WT % |
|---|---|---|---|
| Base Matrix 2 | 64.00 | 64.00 | 64.00 |
| Sodium tartrate mono- and di-succinate (80:20 mix) | 6.00 | 6.00 | 6.00 |
| Sodium citrate, dihydrate | 6.12 | 6.12 | 6.12 |
| Sodium formate | 0.39 | 0.39 | 0.39 |
| Lipase (100,000 LU/g) | 0.75 | 0.75 | 0.75 |
| Protease B (34 g/L) | 0.70 | 0.70 | 0.70 |
| 1,2 propanediol | 2.00 | 2.00 | 2.00 |
| 3-Aminobenzene boronic acid | 0.50 | — | — |
| 3-Acetamidobenzene boronic acid | — | 0.50 | — |
| 3-Methanesulfonamidobenzene boronic acid | — | — | 0.50 |
| Water | 19.54 | 19.54 | 19.54 |
| TOTAL | 100.00 | 100.00 | 100.00 |
| pH (10% Formulation) | | (7.5–8.1) | |

The lipase activity was measured as described previously (Examples 1–8). The residual activity after 2 and 3 weeks is reported in Table 2 below.

TABLE 2

| | Ki(**) | % RESIDUAL LIPASE ACTIVITY 2 WEEK | 3 WEEK |
|---|---|---|---|
| Example 9 | 2.2 × 10–5 | <5 | <5 |
| Example 10 | n.a. | 8 | <5 |
| Example 11 | 9.4 × 10–6 | 8 | 5 |
| Example 12 | 1.3 × 10–4 | 68 | 54 |
| Example 13 | n.a. | 62 | 50 |
| Example 14 | n.a. | 33 | 30 |

** For subtilisin from Phillip & Bender article cited above.

CONCLUSION: As in previous examples, 3-substituted aryl boronic acids provide superior stability to lipase in the presence of the proteolytic enzyme, contrary to what one would expect from Kis based on the literature.

Other compositions of the present invention are obtained when Protease B is substituted with other proteolytic enzymes such as Alcalase® and BPN', and/or lipase is substituted by other enzymes such as amylase.

EXAMPLES 15–17

The following concentrated, built, base formula is made and used in Examples 15–17.

BASE MATRIX 3

| COMPONENT | WT % |
|---|---|
| 1) C14–15 alkyl polyethoxylate (2.25) sulfonic acid | 9.30 |
| 2) C12.3 linear alkyl benzene sulfonic acid | 4.70 |
| 3) Polyhydroxy $C_{12-14}$ fatty acid amide | 4.70 |
| 4) Sodium cumene sulfonate | 6.00 |
| 5) Ethanol | 1.29 |

-continued

| BASE MATRIX 3 | |
|---|---|
| COMPONENT | WT % |
| 6) 1,2 propane diol | 6.00 |
| 7) Sodium hydroxide | 1.14 |
| 8) Potassium hydroxide | 3.00 |
| 9) Sodium tartrate mono- and di-succinate (80:20 mix) | 6.00 |
| 10) Citric acid | 4.00 |
| 11) $C_{12-14}$ alkenyl succinic acid | 4.00 |
| 12) Sodium formate | 0.40 |
| 13) Water/Misc. | 36.97 |
| 14) Ingredients per Examples 15–17 | 12.50 |
| TOTAL | 100.00 |

The composition is made by adding the ingredients in the above order and used in the formulations below.

| | EX 15 WT % | EX 16 WT % | EX 17 WT % |
|---|---|---|---|
| Base Matrix 3 | 87.50 | 87.50 | 87.50 |
| Protease B (34 g/L) | 0.55 | 0.55 | 0.55 |
| Lipase (100,000 LU/g) | 0.75 | 0.75 | 0.75 |
| 4-Methoxybenzene boronic acid | 1.00 | — | — |
| 3-Aminobenzene boronic acid | — | 1.00 | — |
| 3-Acetamidobenzene boronic acid | — | — | 1.00 |
| Water | 10.20 | 10.20 | 10.20 |
| TOTAL | 100.00 | 100.00 | 100.00 |
| pH (10% Solution) | | (7.9–8.5) | |

Lipase activity is measured as explained previously (Examples 1–8). The residual activity after 9 and 20 days is reported in Table 3 below.

| | DATA TABLE 3 % RETAINED LIPASE ACTIVITY | |
|---|---|---|
| | 9 DAYS | 20 DAYS |
| Example 15 | 4 | 0 |
| Example 16 | 73 | 55 |
| Example 17 | 84 | 68 |

CONCLUSIONS: The 3-substituted aryl boronic acids provide significantly superior lipase stability (Examples 16–17) compared to other boronic acids (Example 15).

Other compositions of the present invention are obtained when Protease B is substituted with other proteases such as Alcalase® and BPN', and/or lipase is substituted by other second enzymes such as amylase.

EXAMPLES 18–20

The Base Matrix composition shown below is made and used in Examples 18–20 below:

| BASE MATRIX 4 | |
|---|---|
| COMPONENT | WT % |
| 1) C14–15 alkyl polyethoxylate (2.25) sulfonic acid | 12.00 |
| 2) C12.3 linear alkylbenzene sulfonate | 12.50 |

-continued

| BASE MATRIX 4 | |
|---|---|
| COMPONENT | WT % |
| 3) C12–13 alkyl polyethoxylate (6.5) | 3.00 |
| 4) Sodium cumene sulfonate | 6.00 |
| 5) Ethanol | 1.47 |
| 6) 1,2 propanediol | 4.00 |
| 7) Sodium hydroxide | 2.00 |
| 8) Tetraethylenepentaamine ethoxylate (15–18) | 1.50 |
| 9) Water/Misc. | 45.03 |
| 10) Ingredients per Examples 18–20 | 12.50 |
| TOTAL | 100.00 |

The Base Matrix 4 is used in the Examples 18–20 below.

| | EX 18 WT % | EX 19 WT % | EX 20 WT % |
|---|---|---|---|
| Base | 87.50 | 87.50 | 87.50 |
| Protease B (34 g/L) | 0.55 | 0.55 | 0.55 |
| Lipolase (100,000 LU/g) | 0.75 | 0.75 | 0.75 |
| 3-Nitrobenzene boronic acid | 0.20 | — | — |
| 3-Aminobenzene boronic acid | — | 0.20 | — |
| 3-Acetamidobenzene boronic acid | — | — | 0.20 |
| Water | 11.00 | 11.00 | 11.00 |
| TOTAL | 100.00 | 100.00 | 100.00 |

EXAMPLES 21–23

A base matrix composition was prepared as shown below and used in Examples 21–23 below:

| BASE MATRIX 5 | |
|---|---|
| COMPONENT | WT % |
| 1) C12.3 linear alkylbenzene sulfonic acid | 7.25 |
| 2) C14–15 alkyl polyethoxylate (7) | 8.00 |
| 3) Coconut alkyl sulfonic acid | 1.75 |
| 4) Dodecenyl succinic acid | 5.00 |
| 5) Citric acid | 9.00 |
| 6) Diethylenedinitrilopentakismethylene phosphonic acid | 0.70 |
| 7) Ethanol | 4.00 |
| 8) 1,2 propanediol | 2.00 |
| 9) Sodium hydroxide | 7.70 |
| 10) Water/Misc. | 44.10 |
| 11) Perfume | 0.30 |
| 12) Brightener | 0.16 |
| 13) Suds supressor | 0.03 |
| 14) Calcium chloride | 0.01 |
| 15) Ingredients per Examples 21–23 | 10.00 |
| 16) Ethoxylated polyethylene terephthalate | 0.20 |
| TOTAL | 100.00 |

Base Matrix 5 is used to prepare samples as shown in Examples 1–23.

| | EX 21 WT % | EX 22 WT % | EX 23 WT % |
|---|---|---|---|
| Base Matrix 5 | 90.00 | 90.00 | 90.00 |
| Protease B (34 g/L) | 0.42 | 0.42 | 0.42 |
| Lipase (100,000 LU/g) | 0.50 | 0.50 | 0.50 |

-continued

| | EX 21 WT % | EX 22 WT % | EX 23 WT % |
|---|---|---|---|
| Amylase (100,000 NU/g) | 0.09 | 0.09 | 0.09 |
| 3-Nitrobenzene boronic acid | 0.10 | — | — |
| 3-Dansylaminobenzene boronic acid | — | 0.10 | — |
| Water | 9.34 | 9.34 | 9.44 |
| TOTAL | 100.00 | 100.00 | 100.00 |
| pH (10% Formulation) | | (7.65–7.90) | |

Lipase activity is measured as explained previously (Examples 1–8). The residual activity after 1 and 2 weeks at 35° C. is reported in Table 4 below:

| | DATA TABLE 4 % RETAINED LIPASE ACTIVITY | |
|---|---|---|
| | 1 WEEK | 2 WEEK |
| Example 21 | 93 | 76 |
| Example 22 | 63 | 42 |
| Example 23 | 33 | 18 |

EXAMPLE 24

A composition is made as shown below.

| | |
|---|---|
| $C_{12.3}$ linear alkylbenzene sulfonic acid | 12.0 |
| Sodium $C_{12-15}$ alkyl sulfate | 2.0 |
| $C_{14-15}$ alkyl polyethoxylate sulfonic acid | 2.0 |
| Polyhydroxy $C_{12}$ fatty acid amide | 6.0 |
| $C_{12-15}$ alkyl polyethoxylate (7) | 1.0 |
| Citric acid | 8.5 |
| $C_{12-14}$ alkenyl substituted succinic acid | 8.5 |
| Ethanol | 8 |
| 1,2-propanediol | 2 |
| Sodium hydroxide | 9 |
| Diethylenetriaminepenta(methylene phosphonic acid) | 1 |
| Amylase (143 KNU/g) | 0.1 |
| Lipase (100 KLU/g | 0.3 |
| Protease B (34 g/L) | 0.5 |
| 3 Nitrobenzene boronic acid | 0.5 |
| Calcium chloride | 0.01 |
| Sodium metaborate | 2.2 |
| Water/Misc. | 36.39 |
| TOTAL | 100.00 |

Other compositions of the present invention are obtained when Protease B is substituted with other proteases such as Alcalase®, Savinase® and BPN', and/or lipase is substituted by or used in conjunction with other second enzymes such as amylase.

What is claimed is:

1. A liquid detergent composition comprising:

a) from about 0.001 to 10 weight % of aryl boronic acid of the following structure:

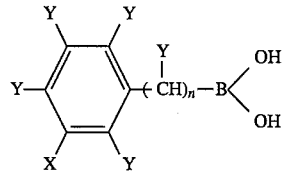

where X is selected from amino, dansylamino, acetamido, methylsulfonamido, and nitro; each Y is independently selected from hydrogen and $C_1$–$C_6$alkyl; and n is between 0 and 4;

b) from about 0.0001 to 1.0 weight % of active proteolytic enzyme;

c) from about 0.0001 to 1.0 weight % on an active basis of a detergent-compatible second enzyme selected from the group consisting of lipase, amylase, cellulase and mixtures thereof; and d) from about 1 to 80 weight % of detersive surfactant.

2. A liquid detergent composition according to claim 1 wherein said detersive surfactant is selected from the group consisting of anionics, nonionics, cationics, ampholytics, zwitterionics, and mixtures thereof.

3. A liquid detergent composition according to claim 2 wherein Y is hydrogen and n is 0.

4. A liquid detergent composition according to claim 3 comprising from about 5 to 50 weight % of anionic and nonionic surfactants.

5. A liquid detergent composition according to claim 3 wherein said second enzyme is lipase in the amount of from about 2 to 20,000 lipase units per gram of product.

6. A liquid detergent composition comprising a) from about 0.02% to 5% by weight of arylboronic acid of the structure:

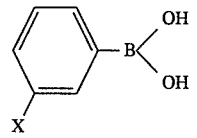

wherein X is amino or nitro;

b) from about 0.0005% to 0.5% by weight of active proteolytic enzyme;

c) from about 0.0001% to 1.0% by weight on an active basis of a detergent-compatible second enzyme selected from the group consisting of lipase, amylase, cellulase and mixtures thereof; and d) from about 5% to 50% by weight of detersive surfactant selected from anionic and nonionic surfactants.

7. A liquid detergent composition according to claim 6 comprising from about 0.0001 to 0.5 weight % on an active enzyme basis of cellulase.

8. A liquid detergent composition according to claim 6 wherein said anionic surfactant comprises $C_{12}$ to $C_{20}$ alkyl sulfate, $C_{12}$ to $_{20}$ alkyl ether sulfate, or $C_9$ to $_{20}$ linear alkylbenzene sulfonate.

9. A liquid detergent composition according to claim 7 wherein said proteolytic enzyme is a serine proteolytic enzyme.

10. A liquid detergent composition according to claim 7 wherein said proteolytic enzyme is selected from the group consisting of Savinase®, Maxacal®, BPN', Protease A, Protease B and mixtures thereof.

11. A liquid detergent composition comprising a) from about 0.2% to 5% by weight of an aryl boronic acid which is acetamidobenzene boronic acid having the structure:

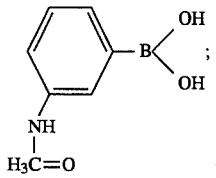

b) from about 0.0005% to 0.5% by weight of active proteolytic enzyme;

c) from about 0.0001% to 1.0% by weight on an active basis of a detergent-compatible second enzyme selected from the group consisting of lipase, amylase, cellulase, and mixtures thereof; and d) from about 5% to 50% by weight of detersive surfactant selected from anionic and nonionic surfactants.

12. A liquid detergent composition according to claim 10 wherein said surfactant comprises from about 1 to 50 weight % of polyhydroxy fatty acid amide surfactant.

13. A liquid detergent composition according to claim 11 wherein said proteolytic enzyme is Protease B.

14. A liquid detergent composition according to claim 12 comprising from about 10 to 6,000 lipase units per gram of product obtained by cloning the gene from *Humicola lanuginosa* and expressing the gene in *Aspergillus oryzae*.

15. A liquid detergent composition according to claim 13 further comprising from about 3 to 30 weight % of polycarboxylate builder.

16. A liquid detergent composition according to claim 14 further comprising from about 0.01 to 10 weight % of soil release agent.

17. A liquid detergent composition according to claim 4 having a pH in a 10% solution in water at 20° C. of between about 6.5 and 11.0.

18. A liquid detergent composition according to claim 16 having a pH in a 10% solution in water at 20° C. of between about 7.0 and 8.5.

19. A heavy duty liquid laundry detergent composition according to claim 11, with from about 15 to 90 weight % of active detergent ingredients.

20. A method for cleaning a substrate by contacting said substrate with a liquid detergent composition according to claim 1.

* * * * *